US008167227B2

(12) United States Patent
Malkin

(10) Patent No.: US 8,167,227 B2
(45) **Date of Patent: *May 1, 2012**

(54) FOOT OPERATED LEVER-LIFT VERTICAL REEL UNROLLER ASSEMBLY

(75) Inventor: Bruce Malkin, Newtown, CT (US)

(73) Assignee: American Products, L.L.C., Strafford, MO (US)

( * ) Notice: Subject to any disclaimer, the term of this patent is extended or adjusted under 35 U.S.C. 154(b) by 306 days.

This patent is subject to a terminal disclaimer.

(21) Appl. No.: 12/503,633

(22) Filed: Jul. 15, 2009

(65) Prior Publication Data

US 2009/0308963 A1 Dec. 17, 2009

Related U.S. Application Data

(63) Continuation-in-part of application No. 12/148,694, filed on Apr. 21, 2008, now Pat. No. 7,588,207.

(51) Int. Cl.
*B65H 75/40* (2006.01)

(52) U.S. Cl. ..... 242/403; 242/533.8; 242/557

(58) Field of Classification Search ..... 242/403, 242/403.1, 533.8, 557, 533.2, 559.1
See application file for complete search history.

(56) References Cited

U.S. PATENT DOCUMENTS

| | | | | |
|---|---|---|---|---|
| 764,344 | A * | 7/1904 | Buckelew | 414/458 |
| 2,481,224 | A * | 9/1949 | Joswick | 242/403.1 |
| 3,764,031 | A * | 10/1973 | Parsen | 414/485 |
| 4,746,078 | A * | 5/1988 | Setzke | 242/559.1 |
| 7,588,207 | B1 * | 9/2009 | Malkin | 242/403 |

* cited by examiner

*Primary Examiner* — Sang Kim
(74) *Attorney, Agent, or Firm* — Lathrop & Gage LLP

(57) ABSTRACT

A lever lift assembly is provided for lifting a reel of cable, wire or other material off the floor. In one embodiment of the lever lift assembly, a lever assembly is actuated to retract a lifter assembly underneath the reel causing the reel to be lifted on a pair of drive wheels and a pair of flanged wheels. In one embodiment the lever lift assembly incorporates drive wheels to unroll material from the reel.

14 Claims, 6 Drawing Sheets

FOOT OPERATED LEVER-LIFT VERTICAL REEL UNROLLER ASSEMBLY

CROSS REFERENCE TO RELATED APPLICATIONS

This non-provisional application is a continuation-in-part of U.S. patent application Ser. No. 12/148,694 filed on Apr. 21, 2008 now U.S. Pat. No. 7,588,207, which application is incorporated herein by reference.

BACKGROUND

Field of the Invention

Reels, or spools, of wire, cable and other material are widely used as an input to manufacturing and further processing of the cable and other materials. Reels provide a convenient method of storing the material, and, when in a vertical position, can be rolled as necessary to aid positioning of the reel on the flanged edges of the reel.

Historically, reel platforms have been used to horizontally stack one or more spools of material. The platforms rotate as material is unspooled and may be powered to assist in spinning the spools. Spools are added to the platform using forklifts, hoists or other lifting mechanisms. More recently, vertical spool unreeling devices have come into use. When it is desired to remove material from the reel, the reel is often lifted and placed on raised rollers to allow the reel to rotate freely on the flanged edges of the reel, thus allowing the material on the reel to be unwound from the reel and processed as desired.

Placing the reel on the rollers can be difficult given the size and weight of the reels, especially when loaded with material. This is especially true since the vertically-oriented reel cannot be rolled into position on the rollers since they are raised above the floor.

In the past manual labor has often been used to lift the reel onto the rollers by brute force. Clearly this is dangerous to the workers lifting the reel and prone to accidents, lack of optimal positioning and other difficulties. This process also requires multiple workers to lift the reel into place.

SUMMARY OF THE INVENTION

The lever lift assembly provides a device and process for lifting a reel onto raised rollers without the problems of the manual process described above. The lever lift assembly allows a single worker to roll the reel into position and raise the reel off the ground onto the rollers for easy rotation without assistance.

The lever lift assembly is safe, secure and positions the reel correctly on the rollers for dispensing the material from the reel, thus addressing the problems associated with the current method of raising loaded reels onto the rollers.

DETAILED DESCRIPTION

Figure 1:
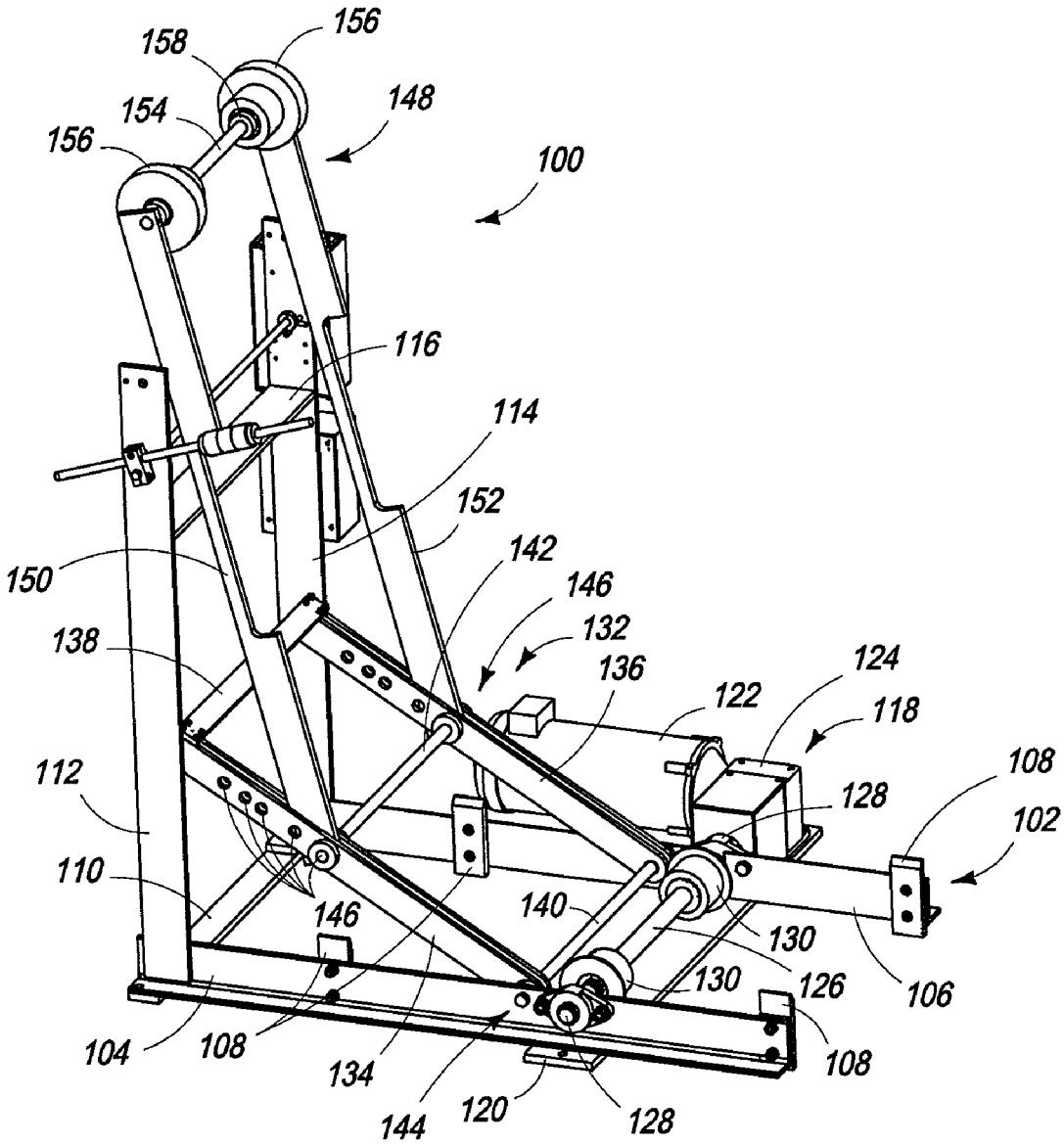
FIG. 1 is a perspective view of an embodiment of the lever lift assembly.

Referring now to FIG. 1, an embodiment of the lever lift assembly 100 is shown in a perspective view. The lever lift assembly includes a base assembly 102 to support the lever lift assembly 100 during use. A preferred embodiment of the lever lift assembly 100 comprises a first base member 104 and a second base member 106. In the embodiment shown in the figures, the first base member 104 and second base member 106 are formed from angle beams, specifically L beams, however the base members could also be formed from channel beams, box beams, I beams, or other structural members. Similarly, the base assembly 102 could be formed from a box or other structural component, or a sheet or plate of suitable material with appropriate mountings for the other components of the lever lift assembly 100, as described below.

In the embodiment shown in the figures, a plurality of guide flanges 108 are attached to the base assembly 102 at various points for guiding the other members of the lever lift assembly 100 during use. Guide flanges 108 may be bolted to the base assembly 102, or formed as an integral part of base assembly 102 or base members 104 or 106. In some embodiments of the invention they may extend along a greater portion or the entire length of the base assembly 102.

In the embodiment of the base assembly 102 shown in FIG. 1, a cross member 110 connects the first base member 104 and the second base member 106 at a first end of each base member 104 and 106. Other embodiments of the lever lift assembly 100 may have multiple cross members or a single cross member that extends for most or all of the length of base members 104 and 106.

Optionally, the base assembly 102 further comprises a vertical element for holding the lifter assembly described hereafter and for guiding the cable or other material to be unspooled from the vertical reel. In a preferred embodiment of the lever lift assembly 100, the optional vertical element is formed from a first vertical member 112, a second vertical member 114 and a vertical cross member 116. The first vertical member 112 and the second vertical member 114 are attached to the base assembly 102 at the first end of the base members and the first end of the vertical members, and attached to each other by the vertical cross member 116 at a point between the second end of the vertical members 112 and 114 and their midpoint. This configuration of the option vertical element is not intended to be limiting of the lever lift assembly and the vertical element could also be formed in a variety of other configurations to provide support to the lifter assembly 148 and to support the feeding of cable from the vertical reel 200 when in use, as further described below.

Drive shaft assembly 118 is also attached to base assembly 102 to turn the vertical reel on its axis during use thus feeding cable from the reel to other equipment for processing. The drive shaft assembly 118 in an embodiment of the present invention comprises a base plate 120, a drive motor 122, a gear box 124, a drive shaft 126, two bearings 128, and two flanged drive wheels 130. Drive shaft assembly 118 is located along base members 104 and 106 at a position that allows a spool or vertical reel of material to be rolled between base members 104 and 106 and placed in contact with the flanged drive wheels 130.

In the embodiment shown in the figures, the drive motor 122 and gear box 124 are mounted on base plate 120. In some embodiments, base plate 120 may be an integral part of base assembly 102 or may be formed from structural members instead of sheet material. Drive shaft 126 is connected to gear box 124 so that actuation of drive motor 122 will cause the rotation of drive shaft 126. In some embodiments, drive motor 122 may directly drive the drive shaft 126 without any gear box 124.

Drive shaft 126 is supported by two bearings 128 which support the weight of the drive shaft 126, and also the weight of the vertical reel, when the assembly is in use, while still allowing the drive shaft 126 to rotate as driven by the drive motor 122. The bearings 128 are mounted on the base assembly 102 to mounting brackets affixed to the base assembly 102. In the embodiment shown in FIG. 1, the bearings 128 are mounted to base members 104 and 106.

Two flanged drive wheels 130 are mounted on drive shaft 126. The flanged drive wheels are positioned on the drive shaft 126 so that they can accept the vertically-positioned reel of cable between the flanges of the drive wheels 130. Each flanged drive wheel 130 comprises a drum and the raised flange around the outer edge of the wheel 130.

The lever lift assembly 100 further comprises a lever assembly 132. The embodiment of the lever assembly 132 shown in FIG. 1 comprises a first lever member 134, a second lever member 136, a lever cross member 138, a lever shaft 140 and a second lever shaft 142. The first and second lever members 134 and 136, respectively, are pivotally attached at a first end of each member to the lever shaft 140. The lever shaft 140 is rotatably attached to the base assembly 102 at lever pivot point 144.

The first and second lever members 134 and 136, respectively, are attached at a second end of each member to the lever cross member 138. Lever cross member 138 maintains the appropriate separation between the first and second lever members 134 and 136, and provides a place for the user of the lever lift assembly 100 to apply pressure to the lever assembly 132 during use of the device.

The second lever shaft 142 is attached at each end to the first and second lever members 134 and 136, respectively, at lifter pivot points 146 located along length of the members 134 and 136. The lifter pivot points may be located at any point along the length of members 134 and 136, however, the lifter pivot points 146 are generally located between the midpoint and the second end of the members 134 and 136. The second lever shaft 142 may be reconfigured to different lifter pivot points 146 as necessary to accommodate varying sizes of reels.

The lever lift assembly 100 further comprises a lifter assembly 148. In one embodiment, the lifter assembly 148 comprises a first lifter member 150 and a second lifter member 152. The first lifter member 150 and second lifter member 152 are pivotally attached at a first end of each member to the second lever shaft 142, and thereby pivotally attached to the first and second lever members 134 and 136 at lifter pivot points 146.

The lever lift assembly 100 may be reconfigured to accommodate various sizes or diameters of vertical reels by relocating the second lever shaft 142 to the various lever pivot points 146 located on the first and second lever members 134 and 136. Reels with shorter diameters may be accommodated by moving the second lever shaft 142 and the lifter members 150 and 152 to a lifter pivot point 146 located closer to the second end of lever members 134 and 136. Similarly, reels with a longer diameter may be accommodated by moving the second lever shaft 142 and the lifter members 150 and 152 to a lifter pivot point 146 located closer to the first end of lever members 134 and 136.

The first and second lifter members 150 and 152, respectively, are attached a second end of each member to lifter shaft 154. Lifter shaft 154 maintains the appropriate separation between the first and second lifter members 150 and 152, and supports flanged wheels 156. Bearings 158 allow flanged wheels 156 to rotate freely around the lifter shaft 154.

FIG. 1 depicts an embodiment of the lever lift assembly 100 in a retracted position. The following figures depict this embodiment in the various stages of use with a vertical reel of cable or other material stored on a reel.

Figure 2:
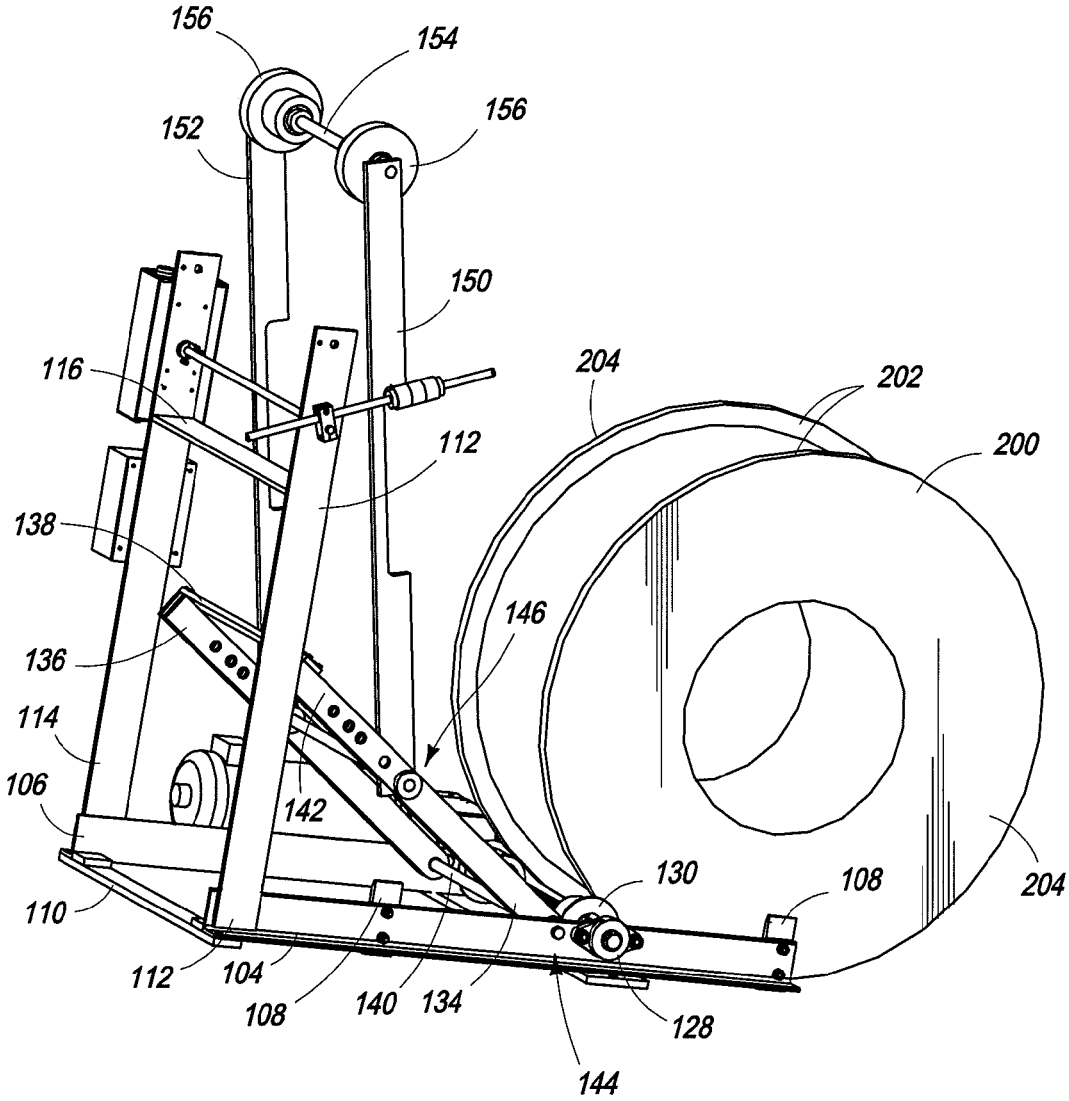
FIG. 2 is a perspective view of an embodiment of the lever lift assembly and a vertical reel.

Referring now to FIG. 2, the lever lift assembly 100 is shown with a vertical reel 200 of cable or other material to be unrolled using the assembly 100. The vertical reel or spool 200 has flanges 202. The cable, wire or other material coiled on the reel 200 is maintained between flanges 202 such that the weight of the reel 200 rests on the flanges 202. Reel 200 can be rolled on the floor on flanges 202 without disturbing the material coiled thereon.

In preparation for unrolling the material from the reel 200, the reel 200 is rolled in between the second ends of base members 104 and 106 until spool flanges 202 come in contact with the flanged drive wheels 130. When properly contacted, the edges of flanges 202 are in contact with the drum of the flanged drive wheels 130, and the outer surface 204 of reel 200 is adjacent to the inner surface of the flange of flanged drive wheel 130.

In FIG. 2, lifter assembly 148 has been rotated around the lifter pivot point 146, and the lever assembly 132 has been rotated around lever pivot point 144 to begin to bring lifter shaft 154 over the top of reel 200, and lifter members 152 and 154 along side the outer surface 204 of reel 200.

Figure 3:
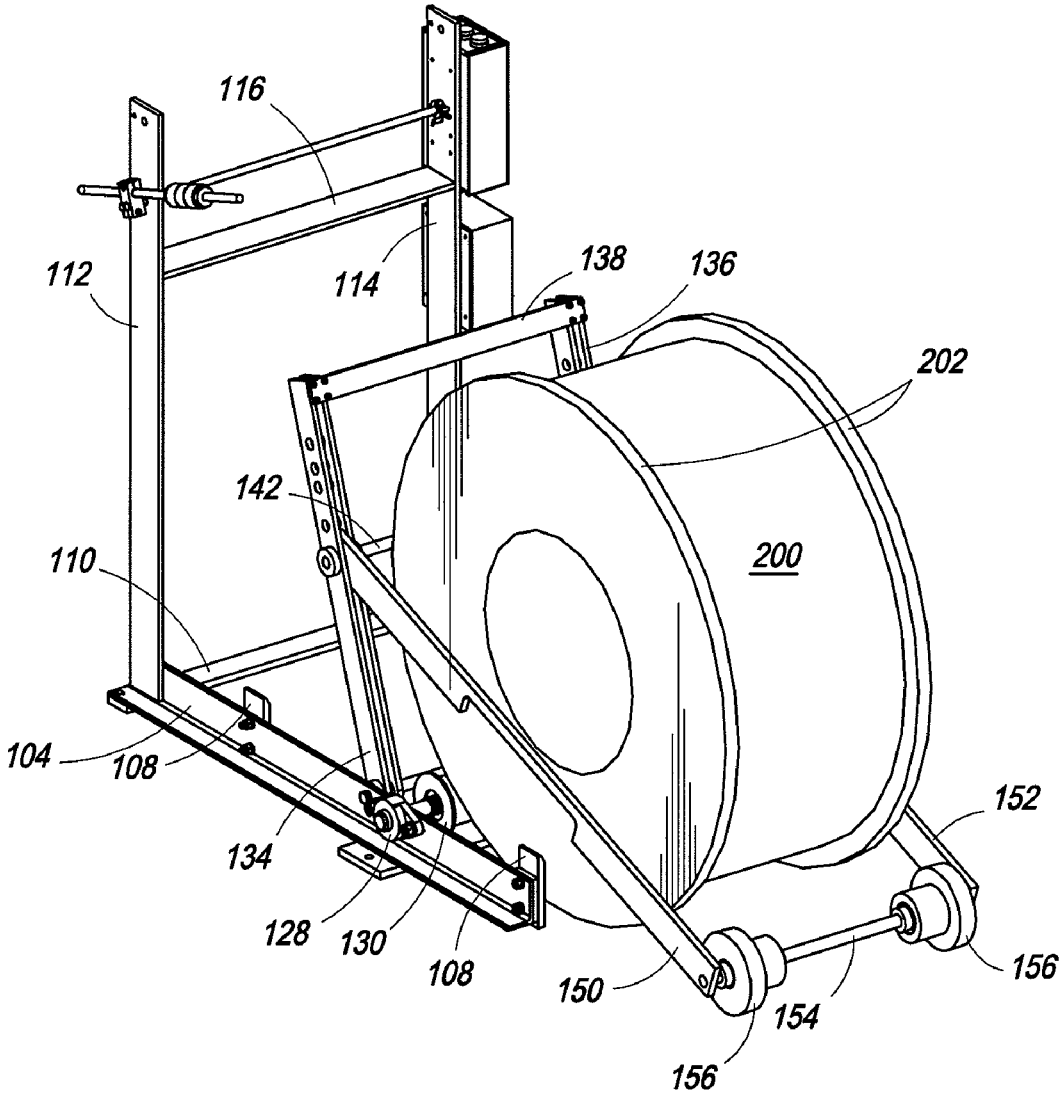
FIG. 3 is a perspective view of an embodiment of the lever lift assembly and a vertical reel.

Referring now to FIG. 3, the lifter assembly 148 has been rotated completely over reel 200, and lever assembly 132 has pivoted up around lever pivot point 144 a sufficient distance to allow the lifter shaft 154 and flanged wheels 156 to pass the reel 200. In this position, flanged wheels 156 rest on the floor and are substantially in the same plane as the base assembly 102, although it is not necessary that they be in exactly the same plane.

Figure 4:
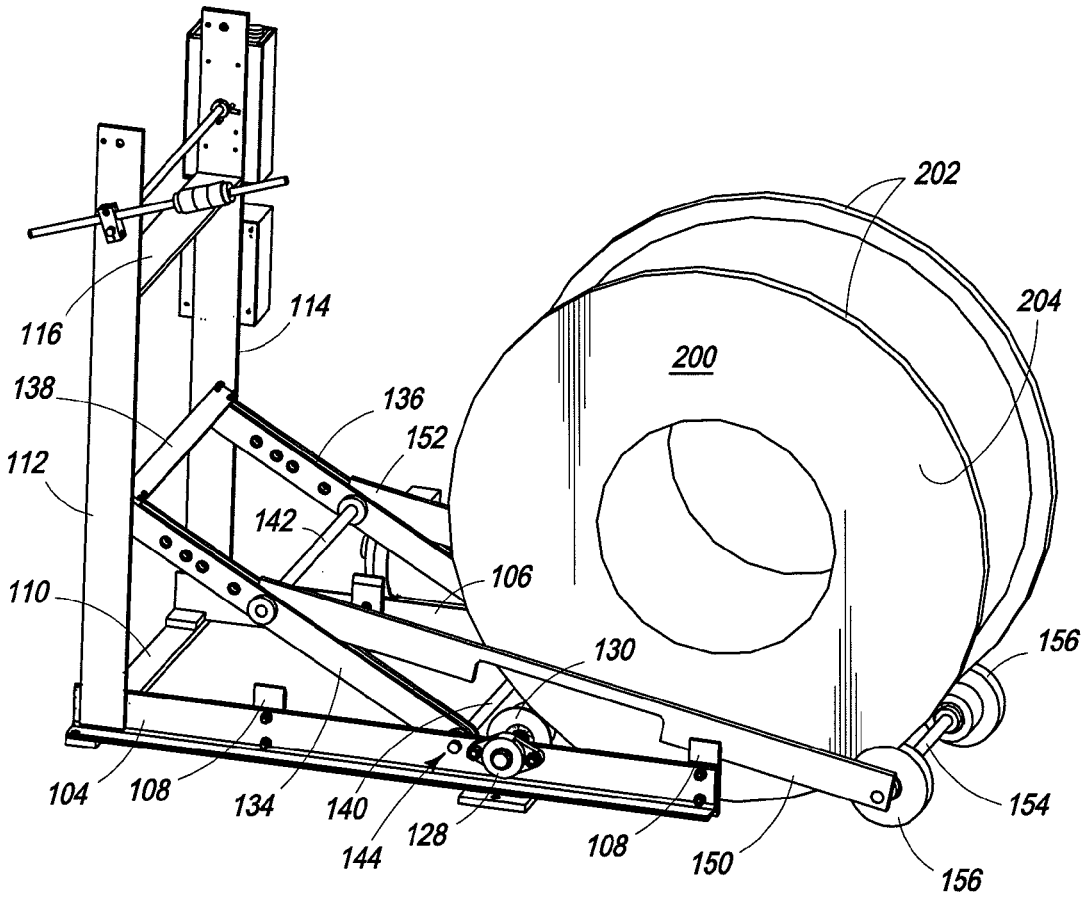
FIG. 4 is a perspective view of an embodiment of the lever lift assembly and a vertical reel.

Referring now to FIG. 4, the next step in preparing the reel 200 for unrolling using the assembly 100 is to begin to pivot the lever assembly 132 down toward the base assembly 102 around lever pivot point 144. As lever assembly 132 pivots around the lever pivot point 144, the lifter assembly 148 pivots around the lifter pivot point 146 relative to the lever assembly 132 and is pulled toward the reel 200. As the flanged wheels 156 are pulled closer to reel 200 the drums of flanged wheels 156 contact the edges of spool flanges 202, and the inner surfaces of the flanges of wheels 156 are adjacent to the outer surface 204 of reel 200.

Figure 5:
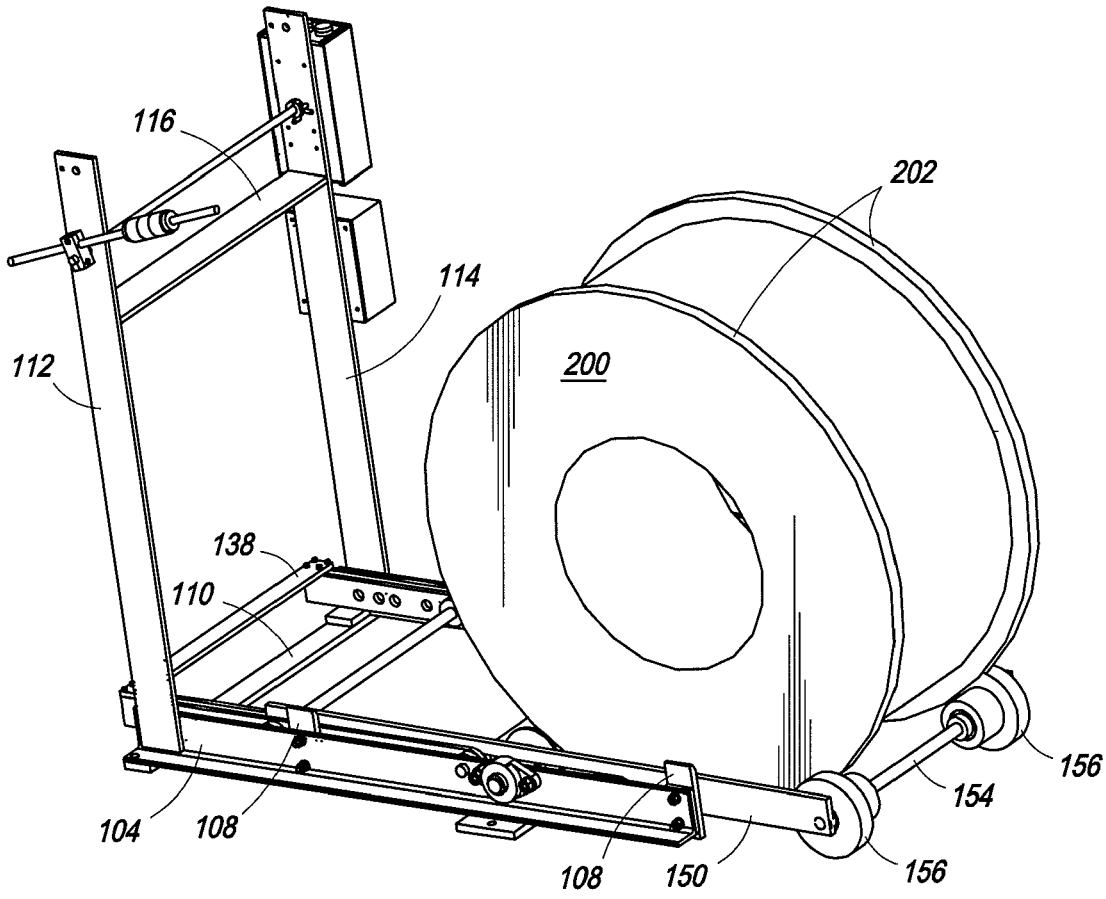
FIG. 5 is a perspective view of an embodiment of the lever lift assembly and a vertical reel.

Referring now to FIG. 5, the lever assembly 132 has been fully pivoted down to the base assembly 102. Consequently, lifter assembly 148 also pivots down to rest on the base assembly 102 and simultaneously pulls flanged wheels 156 closer to flanged drive wheels 130. Since flanged drive wheels 130 are fixed to the base assembly 102, and both drive wheels 130 and flanged wheels 156 are already in contact with reel 200, the decrease in distance between the wheels 130 and 156 forces the reel 200 in an upward direction, lifting it off the floor so that the weight of reel 200 rests on flanged drive wheels 130 and flanged wheels 156. Since flanged wheels 156 turn freely around shaft 154, the operation of the drive motor 122 actuates flanged drive wheels 130 thus turning reel 200. As reel 200 rotates, the cable, wire or other material on the spool can be fed off into other processing equipment as needed by actuating drive motor 122.

When the reel 200 is no longer needed for processing, the process of loading the spool into the lever lift assembly 100 is reversed. The lever assembly 132 is pivoted upward, forcing lifter assembly 148 away from the base assembly 102, and lowering reel 200 onto the floor. Further lifting of lever assembly 132 forces lifter assembly 148 farther from reel 200, causing the flanged wheels 156 to lose contact with reel 200 and extending the lifter members 150 and 152 sufficiently to allow the flanged wheels 156 to be lifted up and over the reel 200. Once the lifter assembly 148 is lifted off the reel 200, it can be rolled away and replaced with another spool.

It is understood that the embodiments described herein and shown in the figures are not the only embodiments of the lever lift assembly, and that other embodiments of the lever lift assembly that operate in the general manner described herein are contemplated by this disclosure and the claims provided herein.

Figure 6:
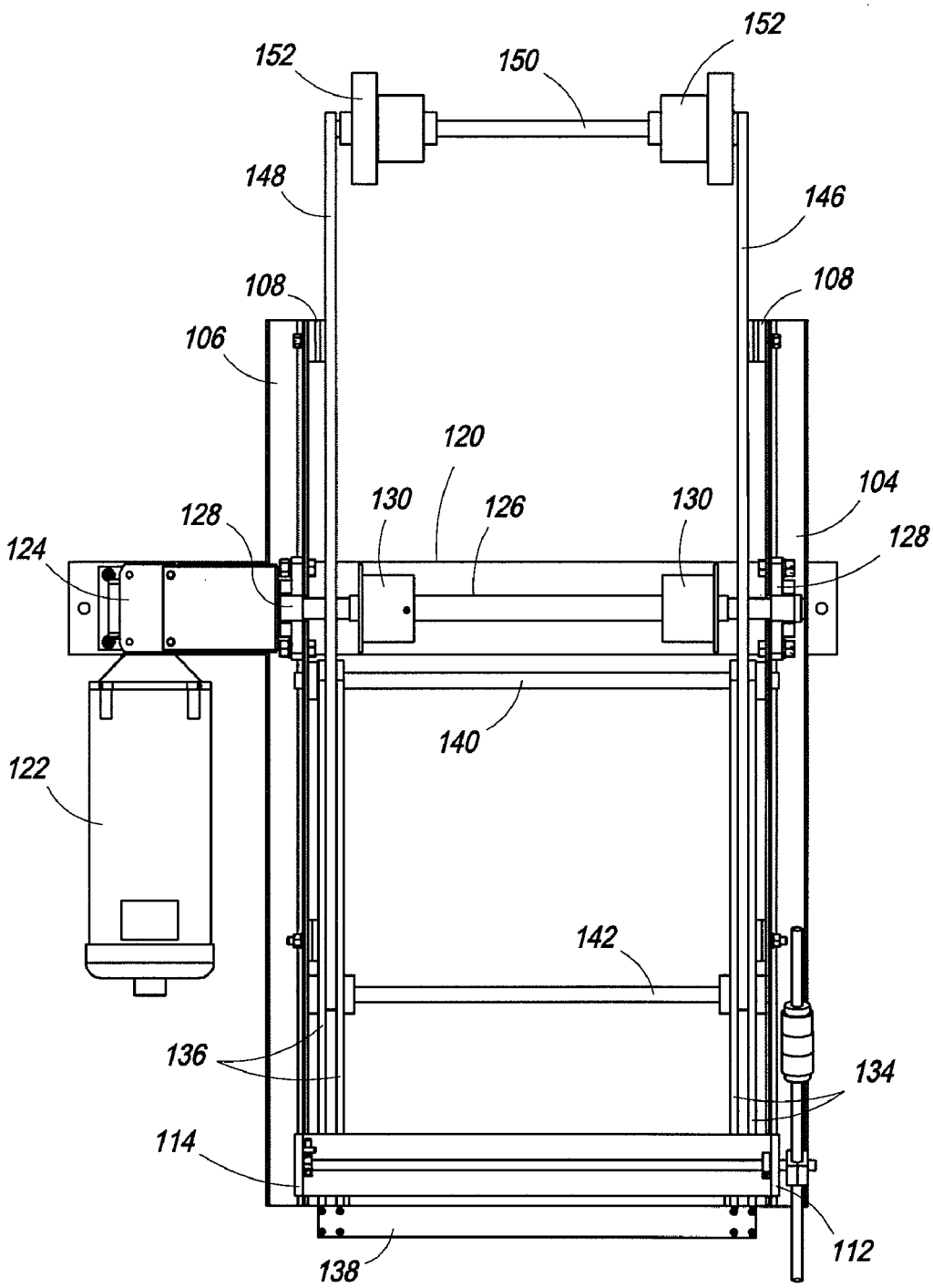
FIG. 6 is a top view of an embodiment of the lever lift assembly.

Referring now to FIG. 6, an embodiment of the lever lift assembly 100 is shown in a top view. The various components of the embodiment are numbered consistently with the description provided for other figures given above. In the embodiment shown in the figures, each of lever lift members 134 and 136 is comprised of two pieces maintained at a distance, or a single member with a channel cut therein. First and second lever members 132 and 134 are secured to lever lift members 134 and 136 between the pieces or in the channel. As the lever assembly 132 is pushed downwards, first and second lever members 132 and 134 fit into the channel or between the pieces.

What is claimed is:

1. A lever lift assembly for a reel comprising:

a base assembly having first and second wheels rotatably attached thereto for receiving the reel;

a lever assembly having a first end and a second end; and a lifter assembly having a first end and a second end and having first and second wheels attached to the second end thereof for receiving the reel;

wherein the first end of the lever assembly is pivotally attached to the base assembly; and wherein the first end of the lifter assembly is pivotally attached to the lever assembly at a point between the first end and the second end of the lever assembly; and wherein the second end of the lever assembly is rotated in a substantially downward direction to lift the reel between the first and second wheels attached to the base assembly and the first and second wheels attached to the lifter assembly.

2. The lever lift assembly of claim 1 wherein the base assembly comprises a first base member, a second base member substantially parallel to the first base member, a cross member perpendicular to the first and second base members and attached to a first end of the first and second base members.

3. The lever lift assembly of claim 1 further comprising a drive shaft assembly, wherein the drive shaft assembly comprises a drive shaft rotatably attached to the base assembly and engaging the first and second wheels mounted on the base assembly, and a drive motor capable of turning the drive shaft.

4. The lever lift assembly of claim 3 wherein the lever assembly comprises a lever shaft attached to the base assembly substantially adjacent to the first and second wheels thereon, a first and a second lever member perpendicular to the lever shaft, each attached at a first end to the opposing ends of the lever shaft, wherein the first and second lever members are capable of pivotal movement with respect to the base assembly at the lever shaft, and a lever cross member perpendicular to and fixedly attached at each end to the second ends of the first and second lever members.

5. The lever lift assembly of claim 4 wherein the lifter assembly comprises a second lever shaft attached to the lever assembly substantially parallel to and separated from the lever shaft, a first and a second lifter member perpendicular to the second lever shaft, each attached at a first end to the opposing ends of the second lever shaft, wherein the first and second lifter members are capable of pivotal movement with respect to the lever assembly at the second lever shaft, a lifter shaft perpendicular to and attached at opposing ends to the second ends of the first and second lifter members, and wherein the first and wheels are rotatably attached to the lifter shaft.

6. The lever lift assembly of claim 5 wherein the second lever shaft can be attached to the first and second lever members at a plurality of points along the lever members to accommodate varying sizes of reels.

7. The lever lift assembly of claim 5 wherein the first and second lever members each comprise two plate members attached together along their length and separated by a gap sufficient to accept the first and second lifter members.

8. The lever lift assembly of claim 7 wherein base assembly further comprises a first and second vertical member attached to a first end of the first and second base members and substantially perpendicular to the base members and the cross member, and a vertical cross member attached at each end to the first and second vertical members at a point along the length of the vertical members.

9. A process for lifting a reel comprising the steps of:

providing a base assembly having first and second wheels rotatably attached thereto for receiving the reel, a lever assembly having a first end and a second end and a lifter assembly having a first end and a second end and having first and second wheels attached to the second end thereof for receiving the reel, wherein the first end of the lever assembly is pivotally attached to the base assembly and the first end of the lifter assembly is pivotally attached to the lever assembly at a point between the first end and the second end of the lever assembly;

providing the reel containing material to be unrolled therefrom;

positioning the reel adjacent to the first and second wheels attached to the base assembly;

pivoting the lever assembly in a generally upward direction to extend the lifter assembly;

pivoting the lifter assembly in a generally downward direction over the reel;

rotating the second end of the lever assembly downwardly thereby retracting the lifter assembly underneath the reel until the reel is lifted between the first and second wheels attached to the base assembly and the first and second wheels attached to the lifter assembly.

10. The process of claim 9 wherein the first and second wheels attached to the base assembly and the first and second wheels attached to the lifter assembly are flanged wheels.

11. The process of claim 10 wherein the step of positioning the reel adjacent to the base assembly further comprises positioning an edge of the reel against each flanged wheel with the flanges extending on an outer surface of the reel.

12. The process of claim 11 wherein the step of retracting the lifter assembly underneath the reel further comprises the steps of:

pivoting the lever assembly in a generally downward direction until the flanged wheels contact the reel;

positioning the flanged wheels on the lifter assembly against the outside edges of the reel; and pivoting the lever assembly in a generally downward direction until the reel is lifted between the flanged drive wheels and the flanged wheels.

13. The process of claim 12 wherein the step of retracting the lifter assembly further comprises the step of reattaching the lifter assembly to the lever assembly at a point on the lever assembly determined by the diameter of the reel.

14. The process of claim 12 wherein the flanged drive wheels are actuated to unroll material from the reel.

* * * * *